United States Patent [19]

Thurley

[11] 4,018,216

[45] Apr. 19, 1977

[54] HEAT EXCHANGE APPARATUS

[75] Inventor: John Thurley, Harrogate, England

[73] Assignee: John Thurley Limited, England

[22] Filed: Apr. 21, 1975

[21] Appl. No.: 569,653

[30] Foreign Application Priority Data

Apr. 29, 1974 United Kingdom ..... 18629/74

[52] U.S. Cl. ..... 126/360 R; 60/39.57; 122/31 A

[51] Int. Cl.[2] ..... F24H 1/20

[58] Field of Search ..... 126/360 R, 360 A; 122/31 A; 60/39.57

[56] References Cited

UNITED STATES PATENTS

| | | | |
|---|---|---|---|
| 1,674,282 | 6/1928 | Fletcher | 431/173 |
| 2,333,497 | 11/1943 | Velander | 60/39.57 |
| 3,138,150 | 6/1964 | Hyer et al. | 126/360 A |
| 3,368,548 | 2/1968 | Santoleri et al. | 126/360 A |
| 3,407,805 | 10/1968 | Bougard | 126/360 A |
| 3,738,353 | 6/1973 | Santoleri | 126/360 A |

FOREIGN PATENTS OR APPLICATIONS

| | | | |
|---|---|---|---|
| 551,533 | 4/1923 | France | 122/31 A |

*Primary Examiner*—John J. Camby
*Assistant Examiner*—Larry I. Schwartz
*Attorney, Agent, or Firm*—Jay L. Chaskin

[57] ABSTRACT

Heat exchange apparatus for raising the temperature of a subject fluid in which a fuel burner is located at least partially within a heat-exchange liquid and the subject fluid is passed through heat-exchange liquid, the combustion products of the fuel burner being contacted with the heat exchange fluid in the vicinity of the subject fluid. In this way the fuel burner may be constructed entirely of metal so that large units of low weight may be used. Preferably the fuel burner includes a tangential air inlet and a combustion chamber of frusto-conical form.

13 Claims, 3 Drawing Figures

-FIG. 1-
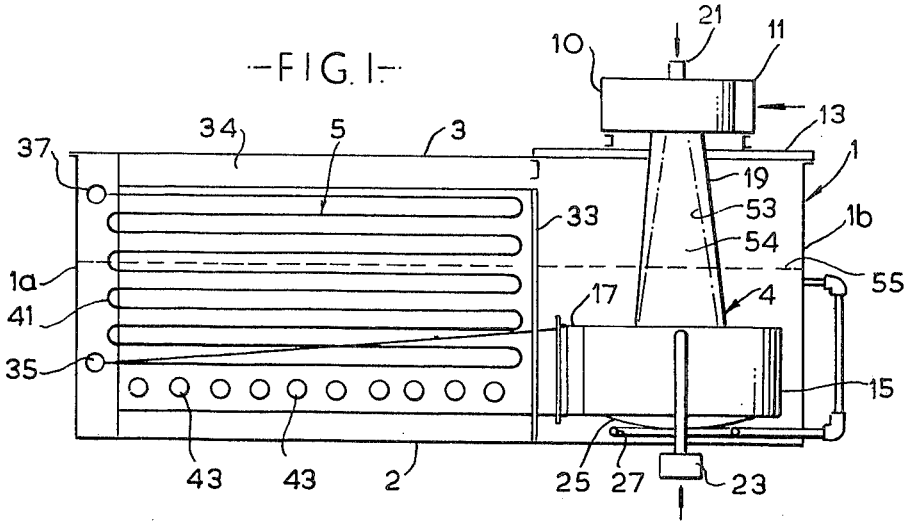
-FIG. 2-
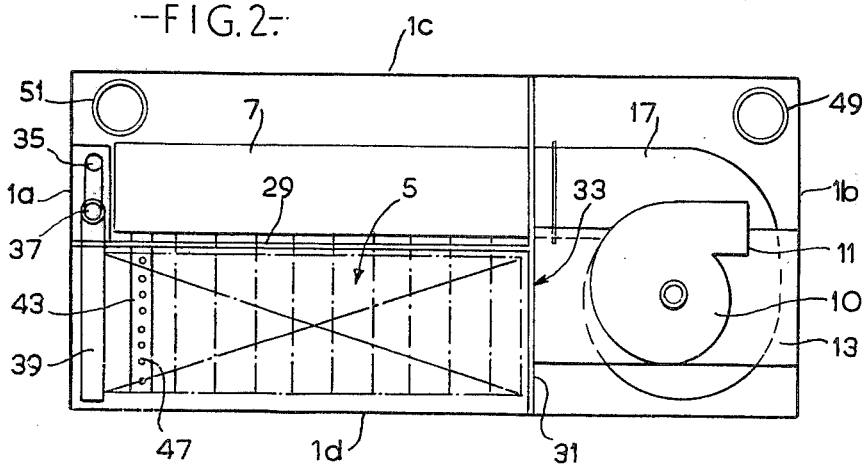
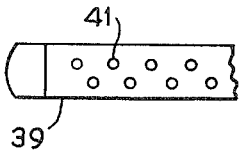
-FIG. 3-

HEAT EXCHANGE APPARATUS

This invention relates to heat exchange apparatus of the type in which a subject fluid contained within fluid passage means, such as a pipe, is passed through a heat exchange fluid and the combustion products from a fuel burner are contacted with the heat exchange fluid in the vessel.

Previously, the fuel burner has been located above a tank holding the heat exchange fluid and the combustion products have been discharged into the heat transfer fluid via a "downcomer" tube. With such arrangements, it has been necessary to line the walls of the burner with refractory material.

According to the present invention there is provided heat exchange apparatus for raising the temperature of a subject fluid, comprising a fuel burner disposed wholly or partially within a container so that, in use, at least a part of the fuel burner is immersed in coolant fluid in the container, a heat exchange vessel within which are situated fluid passage means through which the subject fluid may be passed, the fluid passage means being, in use, immersed in a heat exchange fluid, and means whereby heated combustion products from the fuel burner may be contacted with the heat exchange fluid in the vessel.

The container within which the fuel burner is wholly or partially disposed is preferably identical with or forms part of the vessel within which the fluid passage means are situated. Preferably the fuel burner is situated at one side of the fluid passage means.

By placing the fuel burner wholly or partially under a coolant fluid it is possible to provide a fuel burner constructed entirely of metal. One advantage of the absence of refractory material, which has previously been incorporated to protect the metal walls of burners, is that large units of relatively low weight may be provided. Furthermore, there will be no problems of refractory spalling due to vapour from the heat exchange fluid and the unit should have fast response characteristics.

Preferably the fuel burner includes a tangential air inlet located above the container. Preferably a substantially cylindrical combustion chamber is located within the container so as to be totally immersed in coolant liquid during operation of the apparatus. In this case the air may be passed from the tangential air inlet to the combustion chamber via a vertical connecting duct which is preferably of frusto-conical form, widening in a direction towards the combustion chamber and whose longitudinal axis is coincident with the axes of the tangential air inlet and the combustion chamber. The connecting duct will preferably lie partially immersed in coolant liquid and partially above the level of the coolant liquid. Fuel is introduced into the burner along the above-mentioned longitudinal axis either in an upward direction into the combustion chamber or connecting duct or in a downward direction into the tangential air inlet. Alternatively fuel may be introduced both upwardly and downwardly at the same time.

Combustion products from the fuel burner are preferably exited by a tangential outlet to the feed means for contacting the combustion products with the heat exchange fluid. These feed means preferably include a plurality of distribution tubes situated immediately below the subject fluid passage means so that the combustion products emerge from the distribution tubes into the heat exchange fluid at a position very close to the subject fluid passage means.

Preferably the subject fluid passage means comprise a bundle of tubes provided with a common inlet and a common outlet, each tube being arranged in a serpentine-like formation in a vertical plane between the inlet and the outlet. Preferably the whole assembly of tubes is surrounded by a weir which confines the ascending combustion gases and at the same time allows heat exchange fluid to pass from the space within the weir, that is, surrounding the assembly of tubes, to the space outside the weir or in the opposite direction. However, other means for confining the ascending combustion products in the region of the assembly of tubes may be provided and such means may include means for replacing heat exchange fluid displaced by the ascending combustion products.

The ascending combustion gases heat the subject fluid, whether directly or via the heat exchange fluid, very efficiently, and, where the subject fluid enters the apparatus as a liquid at a very low temperature, e.g., liquid nitrogen, natural gas or methane, it may be easily vapourized within the bundle of tubes.

The location of the subject fluid passage means remote from the fuel burner, whether in the same divided or undivided vessel or separate vessels, allows the passage means to be made of non-heat-resisting materials, such as non-ferrous materials. It is also possible to provide the fluid passage means in the form of extended surface heat exchangers, e.g., plates, rather than tubes. Furthermore, since the fluid passage means is remote from the fuel burner, both these items are easily removable or accessible for maintenance or replacement purposes, and the apparatus is considerably safer in use than previous devices.

An embodiment of the invention will now be described, by way of example only, and with reference to the accompanying drawings, in which:

FIG. 1 is a longitudinal cross-section through heat exchange apparatus in accordance with the invention;

FIG. 2 is a plan view of the heat exchange apparatus of FIG. 1; and

FIG. 3 is a detailed view of part of a tube bundle manifold of the heat exchange apparatus of FIG. 1.

Referring to the drawings, heat exchange apparatus in accordance with the invention includes a metal vessel 1 of rectangular section having short side walls 1*a*, 1*b*, long long side walls 1*c*, 1*d*, base 2 and roof 3. Within vessel 1 there is situated a fuel burner indicated generally at 4, subject fluid passage means comprising a bundle of tubes 5 and feed means comprising distribution duct 7 and a number of distribution tubes 9 whereby the combustion products from the fuel burner 4 may be contacted with heat exchange fluid surrounding the bundle of tubes 5.

Fuel burner 4 includes an upper chamber 10 of substantially cylindrical form which is provided with a tangential air inlet 11. Chamber 10 is mounted on a platform 13 forming part of the roof 3 of vessel 1. Within vessel 1 and directly below upper chamber 10 is a metal combustion chamber 15 which is also of substantially cylindrical form and which is provided with a tangential outlet 17. The upper chamber 10 and combustion chamber 15 are connected by means of a duct 19 which is arranged vertically and is of frusto-conical form, the cross-sectional area increasing in a direction towards combustion chamber 15. Upper chamber 10 is provided at the centre of its upper wall with a fuel inlet 21 for injecting fuel into the centre of chamber 10 and thence along the axis of duct 19. Combustion chamber 15 is also provided with a fuel inlet 23 so that fuel enters upwardly into the combustion chamber emerging at a point just below the lower end of duct 19 and also on the axis of this duct.

The combustion chamber 15 is provided with a dished bottom surface 25 which may be kept cool during operation of the burner by means of sprays of water directed onto the surface 25 through outlets located in a tube 27 disposed beneath surface 25. The combustion chamber may also, if desired, be provided with a dished top surface to reduce vibration due to pulsations of the burning gases.

The bundle of tubes 5 are located in one corner portion of vessel 1, this portion being bounded on two sides by walls 1*a*, 1*d* of vessel 1, and within vessel 1 by two walls 29 and 31 of a weir 33. Weir 33 closely surrounds the bundle of tubes 5 but the top edges of the walls 29, 31 of the weir 33 lie some distance below the roof of vessel 1, thereby providing a space 34, and a gap is provided between the bottom of the weir 33 and the floor of vessel 1. (Alternatively ports are provided in the walls of weir 33 close to the base of vessel 1.)

The subject fluid enters vessel 1 via inlet 35 and exits from the vessel via outlet 37. Inlet 35 connects with a tube bundle manifold (not shown) located at the bottom of vessel 1 and outlet 37 is connected with an identical tube bundle manifold 39 located vertically above the first mentioned manifold near the top of vessel 1. Between the two manifolds run a plurality of small diameter tubes 41, each tube being arranged in a serpentine-like formation in a vertical plane. Thus each tube may run backwards and forwards many times parallel to wall 1*d* of vessel 1 and along the entire length of space enclosed by weir 33.

Tangential outlet 17 of fuel burner 4 connects with distribution duct 7 which is of comparatively large diameter and which lies close to the base of vessel 1 and runs along the length of weir 33. Projecting at right angles from distribution duct 7 are a plurality of distribution tubes 43, each of which extends below the bundle of tubes 5. Each distribution tube 45 is provided with a number of ports 47, these ports 47 being disposed in the uppermost part of tube 45.

Located in the ceiling of vessel 1 so as to connect with space 34 are two chimneys or stacks 49, 51.

In operation air is supplied to upper chamber 10 via tangential air inlet 11, the air then passing downwardly through duct 19 along a helical path towards combustion chamber 15, thereby forming a layer of cool air 53 adjacent the metal wall of duct 19. Fuel is injected via one or both of fuel inlets 21 and 23 along the longitudinal axis of duct 19 and, on ignition, combustion of the fuel occurs mainly in the space 54 surrounded by cool air layer 53 in tube 19 and also within metal combustion chamber 15.

Vessel 1 is filled with a heat exchange fluid, in this case water, to a level indicated by line 55 and it will be seen that below the level of the water the metal of duct 19 and combustion chamber 15 is cooled by the water and above the water level the cool air 53 maintains the metal wall of duct 19 at a reasonably low temperature. It has been accordingly found that refractory material is not required in the fuel burner 4. Where the space under combustion chamber 15 is not filled with water, water may be sprayed from tube 27 onto the dished under surface of the chamber.

The combustion products from combustion chamber 15 pass into tangential outlet 17, along distribution duct 7 and into distribution tubes 43. The combustion products exit from tubes 43 via ports 47 into water located within weir 33 and immediately below the bottom run of the bundle of tubes 5. The combustion products ascend through the water in the weir and since the walls 29, 31 of the weir 33 and walls 1*a*, 1*d*of vessel 1 closely surround the bundle of tubes 5 the ascending combustion products are forced to pass between the tubes in the bundle 5 and then make their way to the surface of the water. As a result of the presence of the ascending combustion products within weir 33 the density of the fluid within the weir is considerably less than that outside the weir. Since the fluids inside and outside the weir are in contact beneath the walls of the weir the head of fluid within the weir increases. When the rate of entry of combustion products into the heat exchange fluid contained within the weir is sufficiently high, the heat exchange fluid will overflow into the surrounding liquid. It will be appreciated that, at this stage, the fluid in the weir completely surrounds even the uppermost runs of the bundle of tubes 5. The liquid flowing over the top of the weir is replaced by cooler liquid entering at the bottom of the weir.

In the space 34 above the weir the combustion products separate from the overflowing liquid and pass out of vessel 1 via stacks 49, 51.

The subject fluid which may be a liquid to be vapourised, such as liquid nitrogen, natural gas, methane, oxygen or ethylene is passed via inlet 35 to lower tube manifold 39. The liquid then enters tubes 41 and within each tube the liquid passes lengthwise several times within the weir before entering upper tube manifold 39. During its passage through the heat exchange fluid, the subject fluid is vapourised, the heat exchange across the tubes being very efficient in view of the exchange fluid and around each tube 41.

In an apparatus such as the one described above it is possible to achieve a "turndown" as low as one percent, thus permitting use of only a single burner on units with heat releases as large as 100,000,000 BTu/hr.

The particular arrangement of tangential air inlet 11, tangential outlet 17 and frusto-conical connecting duct 19 provides combustion stability due to vortex action of the gases and minimum pressure drop with resultant maximum mixing and intensity of combustion for a given size of combustion chamber. In heat exchange apparatus according to previous designs a unit having, say, a 72,000,000 BTu/hr. heat release might require a combustion air blower driven by an electric motor with a horse power as high as 250. In the above described apparatus the energy requirement could be reduced by as much as 100HP.

No complicated premix pilot is required as "raw" pilot gas can be injected via either or both fuel inlets 21, 23 along the longitudinal axis of connecting duct 19 and spark ignited. Fuel injection along the axis of duct 19 ensures smooth combustion at a high heat release rate.

I claim:

1. Heat exchange apparatus for raising the temperature of a subject fluid comprising:

A. a fuel burner including:

a. an upper tangential air inlet;
b. a lower combustion products outlet;
c. a portion, lying between the air inlet and the combustion products outlet, where combustion takes place and comprising a frusto-conical duct extending downwardly from the air inlet and opening at its lower end into a chamber, the combustion products outlet extending tangentially from the chamber;
d. a fuel inlet, at least the combustion portion being located in a container, and at least part thereof being, in use, immersed in a coolant liquid;

B. fluid passage means, laterally spaced from the fuel burner, through which a subject fluid may be passed, the fluid passage means being located in a vessel and, in use, at least partially immersed in a heat-exchange fluid;

C. means for feeding heated combustion products from the combustion products outlet to a position below said fluid passage means, and, at this position, releasing the combustion products into the heat exchange fluid.

2. Heat exchange apparatus according to claim 1 wherein the container for the combustion chamber is identical with or forms part of the vessel within which the fluid passage means are located.

3. Heat exchange apparatus according to claim 1 wherein the fuel burner is constructed entirely of metal.

4. Heat exchange apparatus according to claim 1 wherein means are provided for confining the released combustion products as an ascending stream with heat-exchange fluid in intimate contact with said fluid passage means.

5. Heat exchange apparatus according to claim 4 wherein the confining means is a weir.

6. Heat exchange apparatus according to claim 1 wherein the tangential air inlet is to an upper chamber located above the container.

7. Heat exchange apparatus according to claim 1 wherein means are provided for introducing fuel to the burner in a direction along the axis of said duct.

8. Heat exchange apparatus according to claim 7 wherein the fuel introduction means include an upper fuel inlet, whereby fuel may be introduced downwardly into the burner.

9. Heat exchange apparatus according to claim 7 wherein the fuel introduction means include a lower fuel inlet whereby fuel may be introduced upwardly into the combustion chamber.

10. Heat exchange apparatus according to claim 1 wherein the fluid passage means comprises a bundle of tubes provided with a common inlet and a common outlet, each tube being arranged in a serpentine-like formation in a vertical plane between the inlet and the outlet.

11. Heat exchange apparatus according to claim 10 wherein the feed means includes distribution ducts whereby the combustion products may be exited into the heat-exchange fluid directly below the tubes.

12. Heat exchange apparatus according to claim 10 wherein a space is provided between the top of the bundle of tubes and the roof of the vessel to allow separation of the heat exchange fluid and the combustion products.

13. Heat exchange apparatus for raising the temperature of a subject fluid comprising:

A. a vessel for holding a heat exchange fluid,

B. a fuel burner comprising:
a. an upper tangential air inlet;
b. a lower tangential combustion products outlet;
c. an all metal combustion portion, lying between the air inlet and the combustion products outlet, where combustion takes place and comprising a frusto-conical duct extending downwardly from the air inlet and opening at its lower end into a chamber from which extends the combustion products outlet; and
d. a fuel inlet for introducing fuel to the burner in a direction along the axis of said duct, at least a combustion portion being located within the vessel and at least part of said portion being, in use, immersed in the heat exchange fluid;

C. a bundle of tubes through which a subject fluid may passed, the bundle being located within the vessel but laterally spaced from the fuel burner and being, in use, immersed in the heat exchange liquid;

D. a weir surrounding the bundle of tubes;

E. means for feeding heating combustion products to a position below said bundle of tubes and, at this position releasing said combustion product into the heat exchange fluid so that a stream of combustion products and heat exchange fluid ascends within the weir in intimate contact with the bundle of tubes.

* * * * *